US010305163B2

(12) United States Patent
Song et al.

(10) Patent No.: US 10,305,163 B2
(45) Date of Patent: May 28, 2019

(54) METHOD AND APPARATUS FOR SEMITRANSPARENT ANTENNA AND TRANSMISSION LINES

(71) Applicant: GM GLOBAL TECHNOLOGY OPERATIONS LLC, Detroit, MI (US)

(72) Inventors: Hyok Jae Song, Oak Park, CA (US); Melanie S. Yajima, Los Angeles, CA (US); Hasan Sharifi, Agoura Hills, CA (US); Keerti S. Kona, Woodland Hills, CA (US); Igal Bilik, Rehovot (IL)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 85 days.

(21) Appl. No.: 15/676,593

(22) Filed: Aug. 14, 2017

(65) Prior Publication Data

US 2019/0051969 A1 Feb. 14, 2019

(51) Int. Cl.

| | |
|---|---|
| ***H01Q 1/12*** | (2006.01) |
| ***H01Q 1/32*** | (2006.01) |
| ***H01Q 1/38*** | (2006.01) |
| ***H01Q 1/48*** | (2006.01) |

(52) U.S. Cl.
CPC ..... *H01Q 1/1271* (2013.01); *H01Q 1/3233* (2013.01); *H01Q 1/3266* (2013.01); *H01Q 1/38* (2013.01); *H01Q 1/48* (2013.01)

(58) Field of Classification Search
CPC ..... H01Q 1/1271
See application file for complete search history.

(56) References Cited

U.S. PATENT DOCUMENTS

| | | | | |
|---|---|---|---|---|
| 5,872,542 A * | 2/1999 | Simons | H01Q 1/1271 343/700 MS |
| 7,233,296 B2 * | 6/2007 | Song | H01Q 1/1271 343/711 |
| 2015/0029064 A1 * | 1/2015 | Pan | H01Q 1/22 343/720 |

* cited by examiner

*Primary Examiner* — Robert Karacsony
(74) *Attorney, Agent, or Firm* — Lorenz & Kopf LLP

(57) ABSTRACT

The present application generally relates communications and hazard avoidance within a monitored driving environment. More specifically, the application teaches a system for semi-transparent and flexible millimeter wave circuits and antennas using inexpensive PET substrate. The system facilitates the fabrication of millimeter wave circuits, transmission lines and antennas in various optically transparent platform where optical transparency is desired, for example in automotive radar in windows, windshield, and rear/side mirrors.

13 Claims, 4 Drawing Sheets

METHOD AND APPARATUS FOR SEMITRANSPARENT ANTENNA AND TRANSMISSION LINES

BACKGROUND

The present application generally relates to flexible millimeter wave circuits, transmission lines, and antennas. More specifically, the application teaches an apparatus for patterning a honeycomb shape conducting mesh on a thin transparent PET film to facilitate semitransparency while supporting characteristic currents similar to those found in a solid conducting surface.

BACKGROUND INFORMATION

Optically transparent conductors are available in many forms such as indium tin oxide, zinc oxide base transparent conductive films and nanowires. A state of the art transparent conductor made from a random network of nanowires has shown a sheet resistance of less than 0.1 ohm with optical transmission better than 70%. Some conducting meshes formed from such random network of nanowires are found to be not suitable for mm application due to the randomly formed mesh sizes being often too large. For example. a microstrip line for 5 mil thick PET substrate requires the microstrip line width for 50 ohm characteristic impedance to be around 300 μm, and a dimension of such nanowire mesh opening can often exceed 300 μm, which means such a microstrip line cannot be formed using the nanowires.

Alternatively, rectangular or square grids can be employed to achieve optically transparent conductor to replace a solid metal. The solid metal supports all modes of currents naturally inherent in a given shape of the metal, whereas the rectangular/square grids only support currents in orthogonal directions following the given grids, which limits its use to only certain modes it can support. In order to overcome this, a finer grid has to be used to make it perform as close to the solid metal. In light of the prior arts, it is not obvious that one considers the current modes which can be supported by the semi-transparent grid structure. All prior arts seem only concern about conductivity or sheet resistance of the grids. It would be desirable to make semi-transparent and flexible circuits and antennas at millimetermave (mmW) frequencies using inexpensive PET substrate and a standard lithography and etching processes. The mmW circuits and antennas should have both optical transparency and flexibility to make them suitable for any flat and curved glass surfaces as a potential installation space.

SUMMARY

Embodiments according to the present disclosure provide a number of advantages. For example, embodiments according to the present disclosure may enable increase visibility in transparent conductor applications while increasing conductivity and enabling greater application of the embodiments. Embodiments according to the present disclosure may thus be more robust, increasing customer satisfaction.

In accordance with an aspect of the present invention, an apparatus comprising a dielectric material having a first surface and a second surface, a first conductor formed on the first surface wherein the first conductor is formed in a honeycomb pattern, and a second conductor formed on the second surface wherein the second conductor is formed in a honeycomb pattern.

In accordance with another aspect of the present invention, an antenna comprising a dielectric material having a first surface and a second surface, an element formed on the first surface wherein the element is formed in a honeycomb pattern, and a ground plane formed on the second surface wherein the ground plane is formed in a honeycomb pattern.

In accordance with another aspect of the present invention, a vehicular antenna system comprising a windshield having an outside surface and an inside surface, an antenna affixed to the inside surface of the windshield wherein the antenna employs a dielectric substrate having a first antenna element formed thereon, wherein the antenna element is fabricated using a honeycomb pattern, an impedance matching circuit, and a transmission line having a honeycomb pattern coupling the antenna element to the impedance matching circuit.

The above advantage and other advantages and features of the present disclosure will be apparent from the following detailed description of the preferred embodiments when taken in connection with the accompanying drawings.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate preferred embodiments of the invention, and such exemplifications are not to be construed as limiting the scope of the invention in any manner.

DETAILED DESCRIPTION

The following detailed description is merely exemplary in nature and is not intended to limit the disclosure or the application and uses thereof. Furthermore, there is no intention to be bound by any theory presented in the preceding background or the following detailed description. For example, the circuitry, transmission lines and antennas of the present invention has particular application for use on a vehicle. However, as will be appreciated by those skilled in the art, the invention may have other applications.

Figure 1:
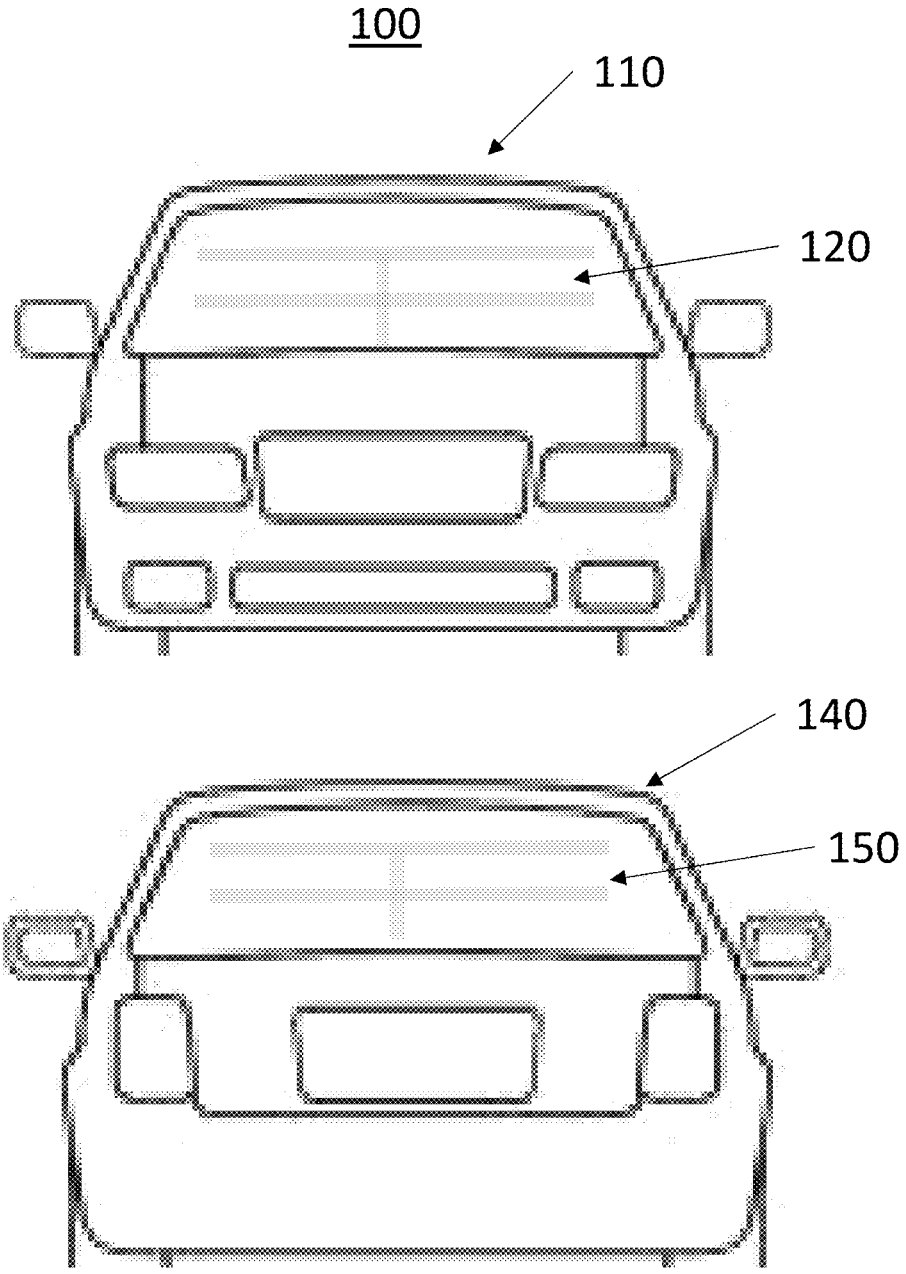
FIG. 1 is a schematic diagram of an exemplary application of the semitransparent antenna and transmission lines in an automotive environment, according to an embodiment.

FIG. 1 schematically illustrates an exemplary application of the semitransparent antenna and transmission lines in an automotive environment 100. The exemplary embodiment proposes a system for semi-transparent and flexible millimeter wave circuits and antennas using inexpensive PET substrate. The system facilitates the fabrication of millimeter wave circuits, transmission lines and antennas in various optically transparent platform where optical transparency is desired, for example in automotive radar in windows, windshield, and rear/side mirrors. An exemplary application is an antenna 120 applied to the front windshield 110 of a vehicle. The front windshield 110 provides a large uninterrupted non conducting surface on which to place an antenna 120. However, the antenna structure 120 must be sufficiently transparent in order not to obstruct the driver view. A second application is shown with a second antenna 150 affixed to a rear window 140 of a vehicle. Again, the second antenna 150 must have sufficient transparency as to not obstruct the driver's view.

Figure 2:
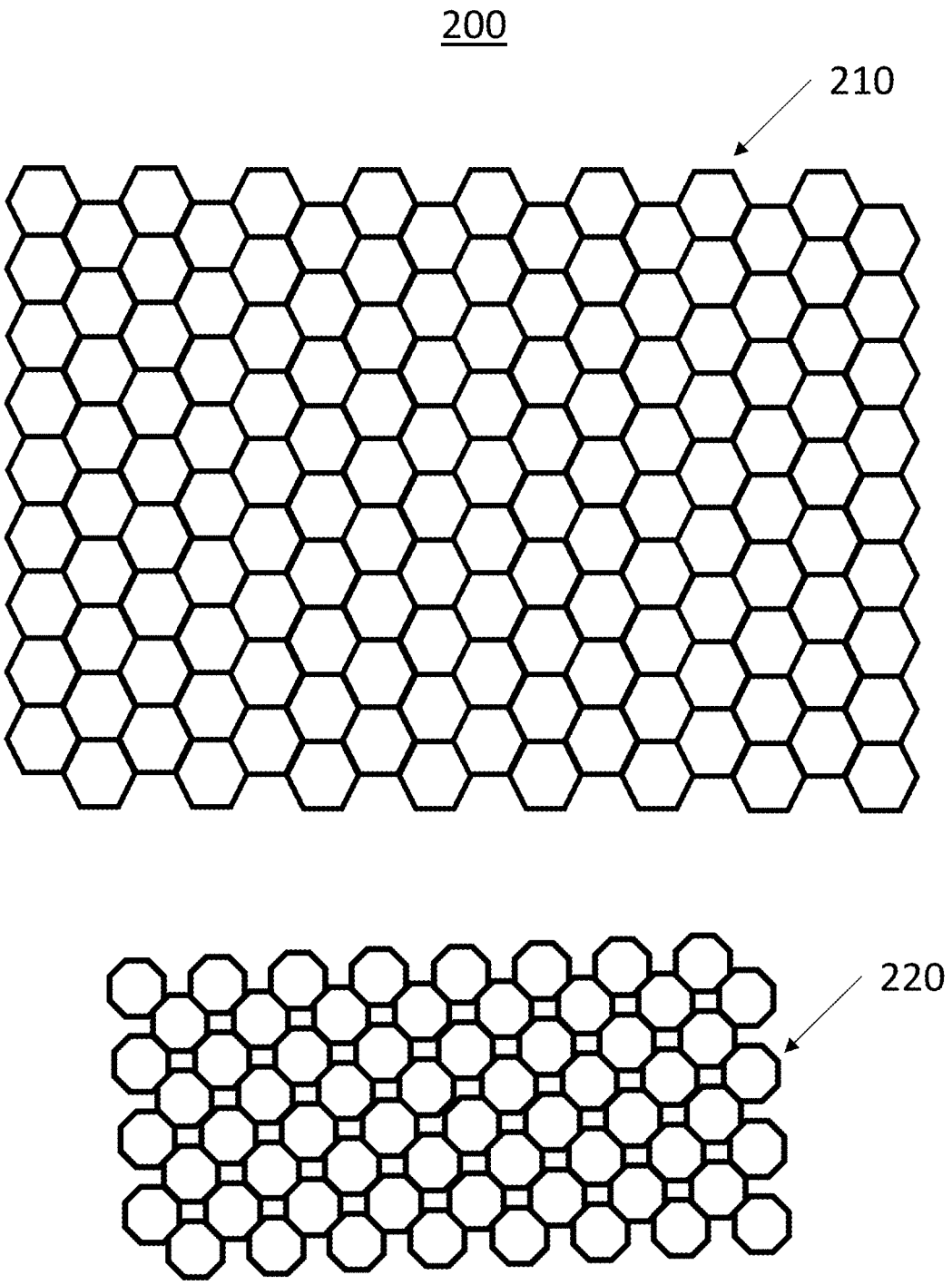
FIG. 2 is a schematic block diagram of an exemplary honeycomb pattern, according to an embodiment.

Turning now to FIG. 2, an exemplary honeycomb pattern 200 according to the present disclosure is shown. The dimensions of the cells of the honeycomb pattern as well as the width of the individual conductors are selected with respect to required transparency and propagation characteristics of the intended millimeter wave signals. Alternatively, an octagon based grid 220 may be implemented. The dimensions of the octagon based honeycomb grid are selected in response to desired millimeter wave propagation characteristics as well as desired transparency. An exemplary configuration may be applied to implement working microstrip and CPW-transmission lines using the honeycomb grid on 5 mil thick polyethylene terephthalate (PET) substrate.

Figure 3:
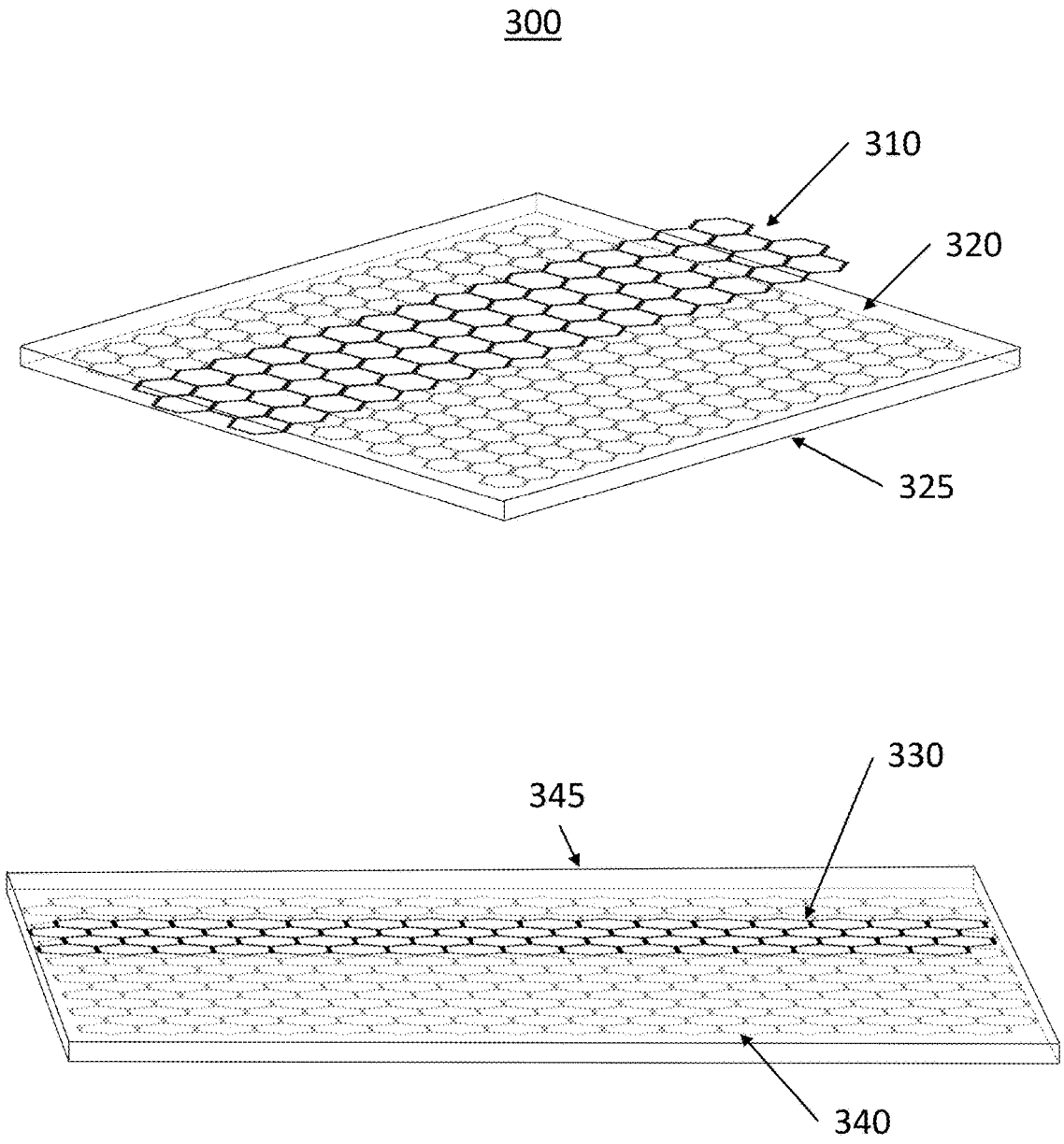
FIG. 3 is a diagram showing an exemplary configuration of a semitransparent transmission line, according to an embodiment.

Turning now to FIG. 3, an exemplary configuration of a semitransparent transmission line 300 is shown. This exemplary embodiment teaches a microstrip line 310 330 fabricated from the honeycomb structure with a particular width and thickness. The spacing and dielectric material 325 345 between the microstrip line 310 330 and the ground plane 320 340 determines the impedance of the microstrip line 310 330. Different lengths of microstrip line and coplanar waveguide lines may be fabricated on PET. In one exemplary embodiment a geometry of 2000 μm long honeycomb patterned microstrip line on the 5-mil thick PET achieved measured transmission loss comperable to simulation results assuming perfect electric conductor (PEG) and gold. The thin strip line forming the honeycomb grid has a line width of 30 μm and a thickness of ~10 μm, and the honeycomb shape has a radius of about 60 μm. The ground plane of the microstrip line also shares the same dimensions of the honeycomb grid used in the microstrip. The transmission loss was approximately 0.7 dB at 77 GHz for the 2000 μm long transmission line. It is possible to fabricate transparent substrates with front side metallization, backside metallization, and through substrate vias using a polyester film substrate with thickness of 125 μm.

Figure 4:
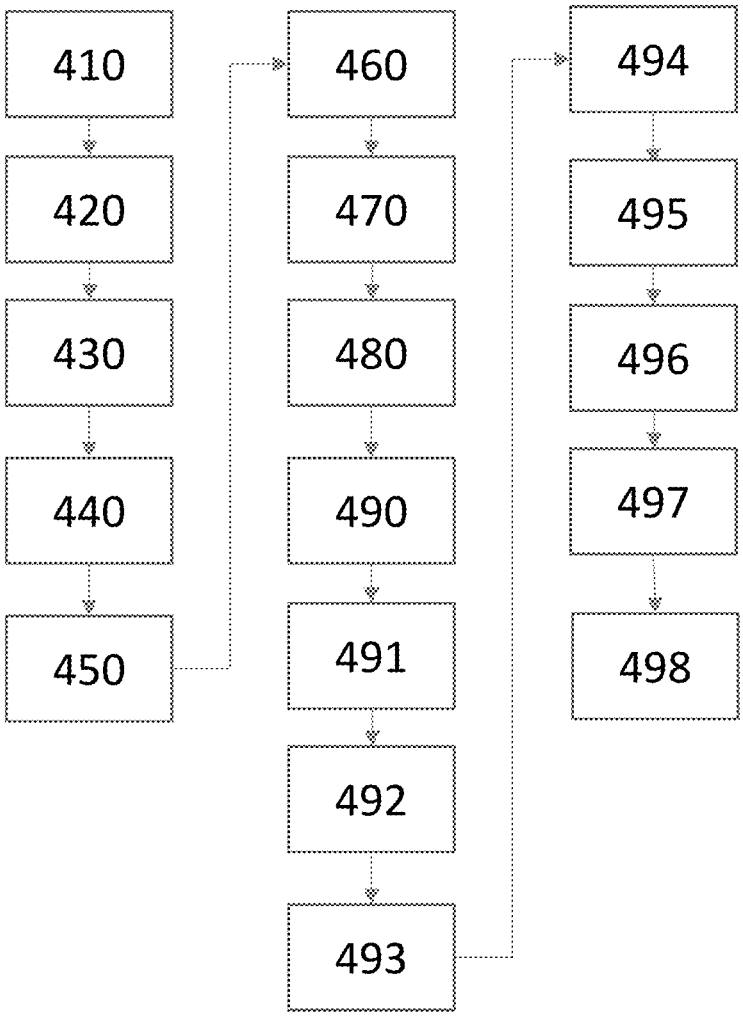
FIG. 4 is a flow chart illustrating the fabrication process for the transparent antenna and transmission line structure.

FIG. 4 illustrates the frontside fabrication process 400 for the transparent substrates. The substrate may first be adhered to a carrier wafer 410 with thermal release tape. The substrate may be solvent cleaned to improve adhesion of subsequent metallization to the substrate. The carrier wafer enables the substrate to remain flat during processing. Next, the frontside of the substrate is then sputtered with a titanium adhesion layer followed by a gold electroplating seed layer 420. A photoresist pattern of the frontside metallization was patterned using contact lithography 430. In an exemplary embodiment, the patterned photoresist may have a thickness up to 23 um. which would enable very thick frontside metalized features. Gold may then be plated 440. For example, the gold plating may have a thickness between 10-15 um.

After gold plating, the photoresist may be removed using solvents 450. The sputtered gold seed layer may then be removed 460 utilizing, for example, ion milling using argon plasma followed by a fluorine plasma etch of the titanium adhesion layer. The substrate may then be removed from the thermal release tape 470 by placing the mounted substrate on a hotplate at elevated temperature in order to release the tape adhesion from the backside of the substrate. At this point, the substrate is ready for backside processing.

For the backside fabrication, the first step was to create blind microvias in the PET substrate from the backside 480, stopping on the frontside metallized features. The microvia fabrication process may be performed using a laser or the like. In an exemplary embodiment, the microvias may be laser drilled using a 602 laser with an entrant diameter of 125 um. The titanium adhesion layer may be employed as a laser etch stop with minimal surface oxidation due to the laser processing. In the next step, the substrate may be re-mounted to a carrier with thermal release tape 490 with the substrate frontside adhered to the tape. The oxidized titanium at the bottom of the microvia is then etched away using fluorine plasma 491. Next, the backside seed layer for gold electroplating is deposited by first sputtering a titanium adhesion layer followed by a gold electroplating seed layer 492. The backside of the substrate may then be plated with a 3 μm blanket gold film 493. Next, using contact lithography, a patterned photoresist mask may be used to protect the metallized features front subsequent gold wet etching 494. Gold etchant is then used to remove the gold in the unmasked field areas 495 to define the backside metallized features. Then the photoresist is removed with solvents 496 followed by plasma etching the titanium adhesion layer using fluorine plasma 497. Finally, the fully fabricated transparent substrate with laser drilled microvias is released from the tape and carrier by placing the mounted substrate on a hotplate at elevated temperature in order to release the tape adhesion from the frontside of the substrate 498. The end result is a fully processed transparent substrate with semi-transparent metallized features.

The invention claimed is:

1. An apparatus comprising:

a dielectric material having a first surface and a second surface;

a first conductor formed on the first surface wherein the first conductor is formed in a honeycomb pattern;

a second conductor formed on the second surface wherein the second conductor is formed in the honeycomb pattern wherein the honeycomb pattern is formed from eight sided cells and four sided cells and wherein the edges of the eight sided cells are formed from a conductive material and the inside of the cell is void of conductive material.

2. The apparatus of claim 1 wherein the honeycomb pattern is formed from six sided cells wherein the edges of the cell are formed from a conductive material and the inside of the cell is void of conductive material.

3. The apparatus of claim 1 where the first conductor is a transmission line.

4. The apparatus of claim 1 wherein the first conductor is a transmission line having a width of four hundred and forty micrometers.

5. The apparatus of claim 1 wherein the second conductor is a ground plane having a width greater than a width of the first conductor.

6. The apparatus of claim 1 wherein the dielectric material is transparent.

7. The apparatus of claim 1 wherein the dielectric material is translucent.

8. An antenna comprising:

a dielectric material having a first surface and a second surface;

an element formed on the first surface wherein the element is formed in a honeycomb pattern; and a ground plane formed on the second surface wherein the ground plane is formed in the honeycomb pattern wherein the honeycomb pattern is formed from eight sided cells and four sided cells and wherein the edges of the eight sided cells are formed from a conductive material and the inside of the cell is void of conductive material.

9. The antenna of claim 8 wherein the honeycomb pattern is formed from six sided cells wherein the edges of the cell are formed from a conductive material and the inside of the cell is void of conductive material.

10. The antenna of claim 8 wherein the ground plane is a reflecting surface.

11. The antenna of claim 8 wherein the antenna is applied to a vehicle surface.

12. The antenna of claim 8 wherein the dielectric material is transparent.

13. The antenna of claim 8 wherein the dielectric material is translucent.

* * * * *